US007067978B2

(12) United States Patent
Kwon et al.

(10) Patent No.: US 7,067,978 B2
(45) Date of Patent: Jun. 27, 2006

(54) PLASMA DISPLAY PANEL (PDP) HAVING UPPER AND LOWER BARRIER RIBS WHOSE WIDTHS HAVE A PREDETERMINED RELATIONSHIP

(75) Inventors: Jae-Ik Kwon, Asan-si (KR); Kyoung-Doo Kang, Seoul (KR); Won-Ju Yi, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/059,680

(22) Filed: Feb. 17, 2005

(65) Prior Publication Data

US 2005/0236986 A1 Oct. 27, 2005

(30) Foreign Application Priority Data

Apr. 27, 2004 (KR) ..... 10-2004-0029156

(51) Int. Cl.
*H01J 17/49* (2006.01)

(52) U.S. Cl. ..... 313/582; 313/583

(58) Field of Classification Search ..... 313/582, 313/583

See application file for complete search history.

(56) References Cited

U.S. PATENT DOCUMENTS 5,004,950 A * 4/1991 Lee ..... 313/582
5,371,437 A * 12/1994 Amano ..... 313/584
5,383,040 A * 1/1995 Kim ..... 313/586
5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,744,909 A * 4/1998 Amano ..... 313/585
5,786,794 A 7/1998 Kishi et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Peter Macchiarolo
(74) *Attorney, Agent, or Firm*—Robert E. Bushnell, Esq.

(57) ABSTRACT

A Plasma Display Panel (PDP) having an improved light emitting efficiency includes: a transparent upper substrate; a lower substrate arranged in parallel to the upper substrate; upper barrier ribs arranged between the upper substrate and the lower substrate, the upper barrier ribs including a dielectric and defining discharge cells with the upper and lower substrates; upper discharge electrodes arranged in the upper barrier ribs to surround the discharge cells; lower discharge electrodes arranged in the upper barrier ribs to surround the discharge cells, the lower discharge electrodes being separated from the upper discharge electrodes; lower barrier ribs of a closed type arranged under the upper barrier ribs, the lower barrier ribs having the same shape as those of the upper barrier ribs; a phosphor layer arranged in each of the discharge cells; and a discharge gas contained within each discharge cell.

19 Claims, 6 Drawing Sheets

U.S. PATENT DOCUMENTS

| | | | | |
|---|---|---|---|---|
| 5,952,782 | A | 9/1999 | Nanto et al. | |
| RE37,444 | E | 11/2001 | Kanazawa | |
| 6,548,957 | B1 * | 4/2003 | Kim et al. | 313/585 |
| 6,630,916 | B1 | 10/2003 | Shinoda | |
| 6,707,436 | B1 | 3/2004 | Setoguchi et al. | |
| 2005/0093444 | A1 * | 5/2005 | Woo et al. | 313/582 |
| 2005/0116646 | A1 * | 6/2005 | Yoo et al. | 313/582 |

FOREIGN PATENT DOCUMENTS

| | | |
|---|---|---|
| JP | 10-172442 | 6/1998 |
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL (PDP) HAVING UPPER AND LOWER BARRIER RIBS WHOSE WIDTHS HAVE A PREDETERMINED RELATIONSHIP

CLAIM OF PRIORITY

This application makes reference to, incorporates the same herein, and claims all benefits accruing under 35 U.S.C. §119 from an application entitled PLASMA DISPLAY PANEL filed with the Korean Intellectual Property Office on Apr. 27, 2004, and there duly assigned Serial No. 2004-29156.

BACKGROUND OF THE INVENTION

1. Technical Field

The present invention relates to a Plasma Display Panel (PDP) having a new structure.

2. Related Art

A Plasma Display Panel (PDP) similar to that shown in Japanese Laid-open Patent No. 1998-172442 includes a lower substrate, address electrodes arranged in parallel to each other on an upper surface of the lower substrate, a lower dielectric layer covering the address electrodes, barrier ribs formed on the lower dielectric layer, a phosphor layer arranged on an upper surface of the lower dielectric layer and a side surface of the barrier rib, an upper substrate arranged in parallel to the lower substrate, sustain electrode pairs disposed on a lower surface of the upper substrate, an upper dielectric layer covering the sustain electrode pairs, and a protective layer covering the upper dielectric layer. The sustain electrode pair includes an X electrode and a Y electrode, and the X electrode and the Y electrode respectively include transparent electrodes and bus electrodes.

In the above-noted PDP, one sub-pixel is defined by one sustain electrode pair and two adjacent barrier ribs. In the PDP having the above-noted structure, a sub-pixel which will emit light is selected by an address discharge between the address electrode and the Y electrode, and the sub-pixel emits light by a sustain discharge between the X electrode and the Y electrode of the selected sub-pixel. In more detail, a discharge gas contained within the sub-pixel emits ultraviolet rays due to the sustain discharge, and the ultraviolet rays cause the phosphor layer to emit visible light. The light emitted from the phosphor layer forms an image displayed on the PDP. There are many ways to improve a light emission efficiency of the PDP, for example, a large volume of a space where the sustain discharge occurs for exciting the discharge gas, a large surface area of the phosphor layer, and no interference for the visible light emitted from the phosphor layer.

However, in the PDP having the above-noted structure, the sustain discharge only occurs between the X electrode and the Y electrode adjacent to the protective layer. Thus, the volume of the space where the sustain discharge occurs is not large, the surface area of the phosphor layer is not large, and some of the visible light emitted from the phosphor layer is absorbed and/or reflected by the protective layer, the upper dielectric layer, the transparent electrodes, and the bus electrodes. Therefore, the visible light passing through the upper substrate is about 60% of the visible rays emitted from the phosphor layer.

SUMMARY OF THE INVENTION

The present invention provides a PDP having an improved light emitting efficiency.

According to an aspect of the present invention, a Plasma Display Panel (PDP) is provided including: a transparent upper substrate; a lower substrate arranged in parallel with the upper substrate; upper barrier ribs arranged between the upper substrate and the lower substrate, the upper barrier ribs including a dielectric and defining discharge cells with the upper and lower substrates; upper discharge electrodes arranged within the upper barrier ribs to surround the discharge cells; lower discharge electrodes arranged within the upper barrier ribs to surround the discharge cells, the lower discharge electrodes being separated from the upper discharge electrodes; lower barrier ribs of closed type arranged under the upper barrier ribs, the lower barrier ribs having the same shape as the upper barrier ribs; a phosphor layer arranged in each of the discharge cells; and a discharge gas contained within each discharge cell.

$(|W1-W2|)/W1$ and $(|W1-W2|)/W2$ are each less than 0.1, with W1 being a lower width of the upper barrier ribs and W2 being an upper width of the lower barrier ribs.

W1 and W2 are preferably equal.

The upper barrier ribs and the lower barrier ribs are preferably respectively formed integrally with each other.

The upper discharge electrodes preferably extend in one direction and the lower discharge electrodes preferably extend in a direction crossing the upper discharge electrodes.

The phosphor layer is preferably arranged on an upper surface of the lower substrate and side surfaces of the lower barrier ribs.

The upper discharge electrodes and the lower discharge electrodes preferably extend in parallel to each other, and address electrodes preferably extend in a direction crossing the upper and lower discharge electrodes.

The address electrodes are preferably arranged between the lower substrate and the phosphor layer, and a dielectric layer is preferably arranged between the phosphor layer and the address electrodes.

The phosphor layer is preferably arranged on an upper surface of the dielectric layer and the side surfaces of the lower barrier ribs.

The upper discharge electrodes and the lower discharge electrodes preferably have ladder shapes, and at least a side surface of the upper barrier ribs is preferably covered by a protective layer.

According to another aspect of the present invention, a Plasma Display Panel (PDP) is provided including: a transparent upper substrate; a lower substrate arranged in parallel to the upper substrate; upper barrier ribs arranged between the upper substrate and the lower substrate, the upper barrier ribs including a dielectric and defining discharge cells with the upper and lower substrates, each of the upper barrier ribs having a lower width W1; upper discharge electrodes arranged within the upper barrier ribs to surround the discharge cells; lower discharge electrodes arranged within the upper barrier ribs to surround the discharge cells, the lower discharge electrodes being separated from the upper discharge electrodes; lower barrier ribs of an open type arranged under the upper barrier ribs, the lower barrier ribs each having an upper width W2; a phosphor layer arranged within each of the discharge cells; and a discharge gas contained within the each discharge cell; wherein$(|W1-W2|)/W1$ and $(|W1-W2|)/W2$ are each less than 0.1.

W1 and W2 are preferably equal.

The upper barrier ribs and the lower barrier ribs are preferably respectively formed integrally with each other.

The upper discharge electrodes preferably extend in one direction, and the lower discharge electrodes preferably extend in a direction crossing the upper discharge electrodes.

The phosphor layer is preferably arranged on an upper surface of the lower substrate and side surfaces of the lower barrier ribs.

The upper discharge electrodes and the lower discharge electrodes preferably extend in parallel to each other, and address electrodes preferably extend in a direction crossing the upper and lower discharge electrodes.

The address electrodes are preferably arranged between the lower substrate and the phosphor layer, and a dielectric layer is preferably arranged between the phosphor layer and the address electrodes.

The phosphor layer is preferably arranged on an upper surface of the dielectric layer and the side surfaces of the lower barrier ribs.

The upper discharge electrode and the lower discharge electrode preferably have ladder shapes, and at least a side surface of the upper barrier ribs is preferably covered by a protective layer.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
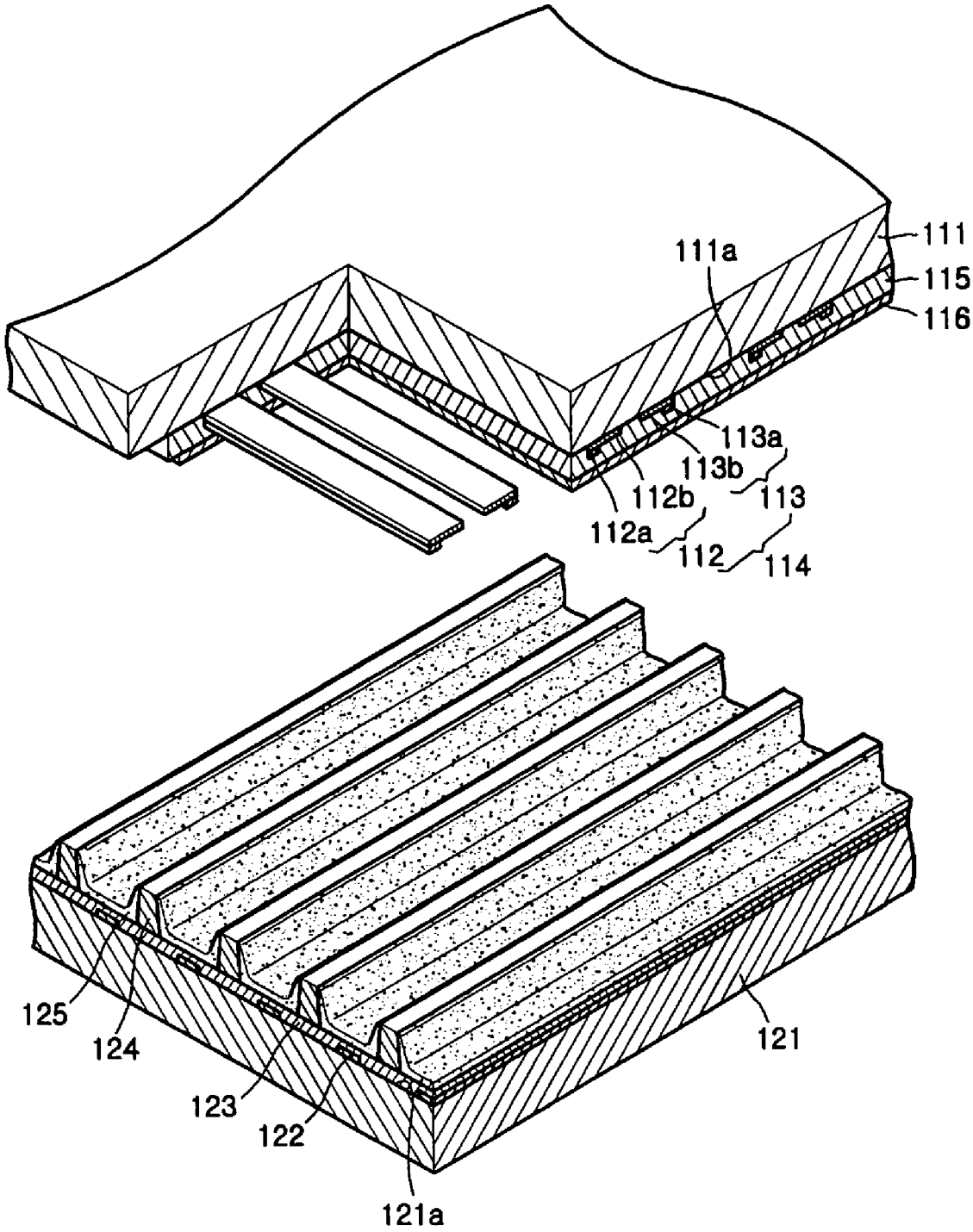
FIG. 1 is a partially cut perspective view of a conventional PDP (PDP)

FIG. 1 is a view of a Plasma Display Panel (PDP) that is similar to that shown in Japanese Laid-open Patent No. 1998-172442. The PDP includes a lower substrate 121, address electrodes 122 arranged in parallel to each other on an upper surface 121*a* of the lower substrate 121, a lower dielectric layer 123 covering the address electrodes 122, barrier ribs 124 formed on the lower dielectric layer 123, a phosphor layer 125 arranged on an upper surface of the lower dielectric layer 123 and a side surface of the barrier rib 124, an upper substrate 111 arranged in parallel to the lower substrate 121, sustain electrode pairs 114 disposed on a lower surface 111*a* of the upper substrate 111, an upper dielectric layer 115 covering the sustain electrode pairs 114, and a protective layer 116 covering the upper dielectric layer 115. The sustain electrode pair 114 includes an X electrode 112 and a Y electrode 113, and the X electrode 112 and the Y electrode 112 respectively include transparent electrodes 112*b* and 113*b* and bus electrodes 112*a* and 113*a*.

In the above-noted PDP 110, one sub-pixel is defined by one sustain electrode pair 114 and two adjacent barrier ribs 124. In the PDP 110 having the above-noted structure, a sub-pixel which will emit light is selected by an address discharge between the address electrode 122 and the Y electrode 113, and the sub-pixel emits light by a sustain discharge between the X electrode 112 and the Y electrode 113 of the selected sub-pixel. In more detail, a discharge gas contained within the sub-pixel emits ultraviolet rays due to the sustain discharge, and the ultraviolet rays cause the phosphor layer 125 to emit visible light. The light emitted from the phosphor layer 125 forms an image displayed on the PDP. There are many ways to improve a light emission efficiency of the PDP 110, for example, a large volume of a space where the sustain discharge occurs for exciting the discharge gas, a large surface area of the phosphor layer, and no interference for the visible light emitted from the phosphor layer.

However, in the PDP 110 having the above-noted structure, the sustain discharge only occurs between the X electrode 112 and the Y electrode 113 adjacent to the protective layer 116. Thus, the volume of the space where the sustain discharge occurs is not large, the surface area of the phosphor layer is not large, and some of the visible light emitted from the phosphor layer 125 is absorbed and/or reflected by the protective layer 116, the upper dielectric layer 115, the transparent electrodes 112*b* and 112*b*, and the bus electrodes 112*a* and 113*a*. Therefore, the visible light passing through the upper substrate is about 60% of the visible rays emitted from the phosphor layer.

A PDP according to a first embodiment of the present invention will be described with reference to FIGS. 2 through 6.

The PDP according to the first embodiment of the present invention includes an upper substrate 211, a lower substrate 221, an upper barrier rib 215, an upper discharge electrode 213, a lower discharge electrode 212, a lower barrier rib 224, a phosphor layer 225, and a discharge gas.

The lower substrate 221 is parallel to the upper substrate 211, and the upper and lower substrates 211 and 221 are fabricated of a transparent material such as glass. On a portion of a lower surface 211*a* of the upper substrate 211, which defines a discharge cell 226, a sustain electrode pair 114 and an upper dielectric layer 115 covering the sustain electrode pair 114 that are conventionally disposed on the lower surface of the upper substrate in the PDP do not exist. Therefore, 80% or more visible rays emitted from the phosphor layer 225 can pass through the upper substrate 211.

Figure 2:
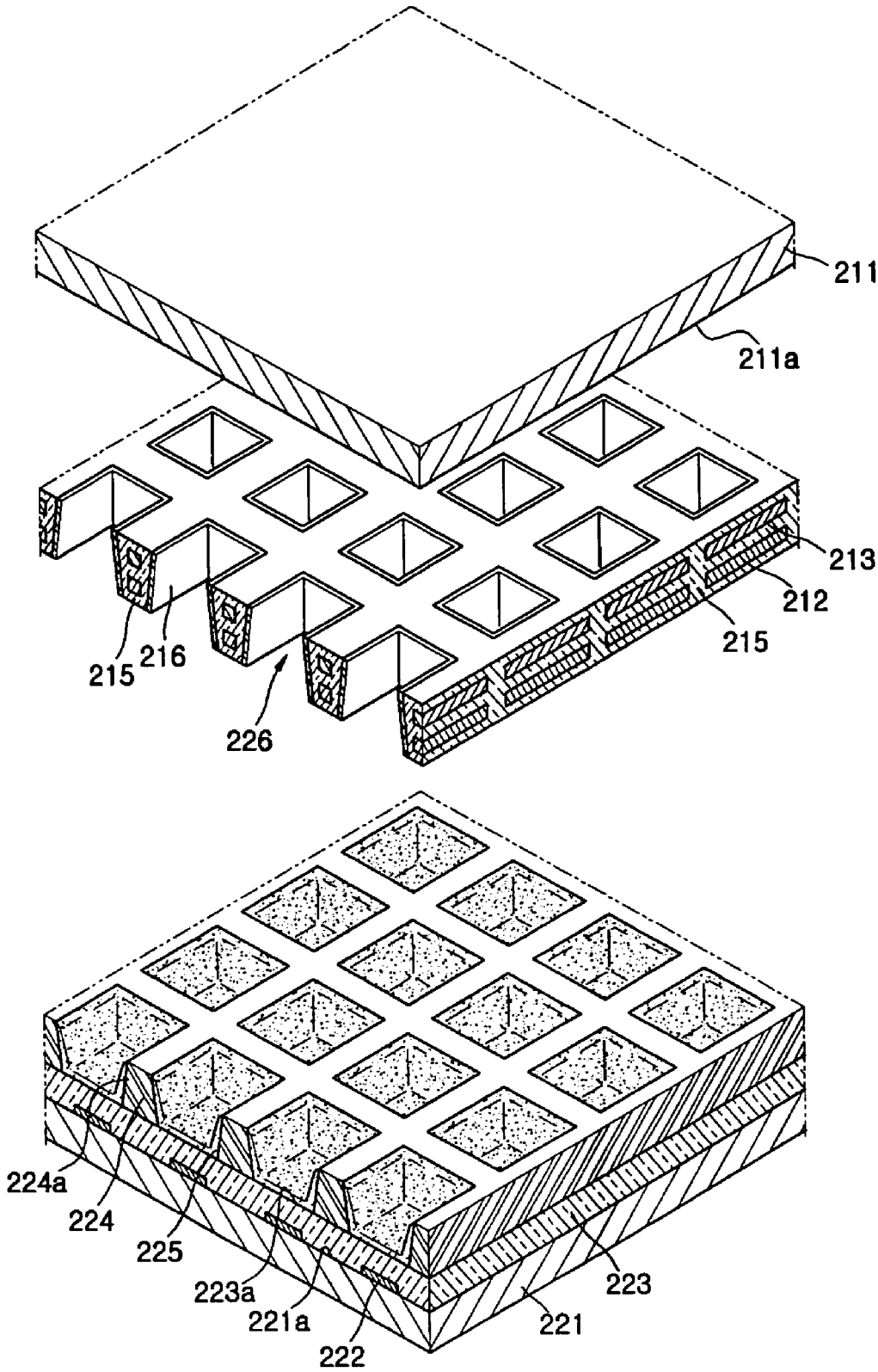
FIG. 2 is a partially exploded perspective view of a PDP according to a first embodiment of the present invention.

The upper barrier ribs 215 that define the discharge cells 226 with the upper substrate 211 and the lower substrate 221 are formed on the lower surface 211*a* of the upper substrate. In FIG. 2, the discharge cells 226 are arranged in a matrix form. However, the present invention is not limited thereto, and the discharge cells 226 can be arranged in a delta form. Also, referring to FIG. 2, a cross-section of the discharge cell 226 is a quadrangle. However, the shape of the cross-section is not limited thereto, and can be a polygon such as a triangle or a pentagon, a circle, or an oval.

The upper barrier rib 215 is a dielectric that can prevent the upper discharge electrode 213 and the lower discharge electrode 212 from electrically coupling to each other during the sustain discharge operation, and can prevent the sustain electrodes 212 and 213 from being damaged by the collision of charged particles thereto. The dielectric can be PbO, $B_2O_3$, or $SiO_2$.

As shown in FIG. 2, it is desirable that a side of the upper barrier rib 215 is covered by the protective layer 216. The protective layer 216 is formed by depositing MgO, and can be formed on a lower surface 215*c*' (refer to FIG. 4) of the upper barrier rib 215 and on the lower surface 211*a* of the upper substrate 211, which defines the discharge cell 226. However, the protective layer 216 formed on the lower surface 215*c*' of the upper barrier rib 215 and the lower substrate 211*a* of the upper substrate 211 does not significantly affect the operation of the PDP. The protective layer 216 is preferably formed on the lower surface 211*a* of the upper substrate 211 in order to discharge secondary electrons.

In the upper barrier rib 215, the upper discharge electrode 213 and a lower electrode 212 that surround the discharge cell 226 are arranged to be separate from each other. In order to arrange the upper discharge electrode 213 and the lower discharge electrode 212 in the upper barrier rib 215, as shown in FIG. 4, a first barrier rib layer 215*a* is formed on the lower surface 211*a* of the upper substrate 211, the upper discharge electrode 213 is formed on the first upper barrier rib layer 215*a*, a second upper barrier rib layer 215*b* is formed to cover the upper discharge electrode 213, the lower discharge electrode 212 is formed on the second upper barrier rib layer 215*b*, and a third upper barrier rib layer 215*c* is formed to cover the lower discharge electrode 212. The first upper barrier rib layer 215*a*, the second upper barrier rib layer 215*b*, and the third upper barrier rib layer 215*c* can have two or more layers respectively, if necessary (for example, for increasing the thicknesses of the respective layers).

The upper discharge electrode 213 and the lower discharge electrode 212 are the electrodes for the sustain discharge, and the sustain discharge occurs between the two electrodes 213 and 212 for displaying the image on the PDP. The upper and lower discharge electrodes 213 and 212 can be formed of a conductive metal such as aluminum or copper, and an address electrode 222, which will be described later, can be formed of the conductive metal.

Figure 3:
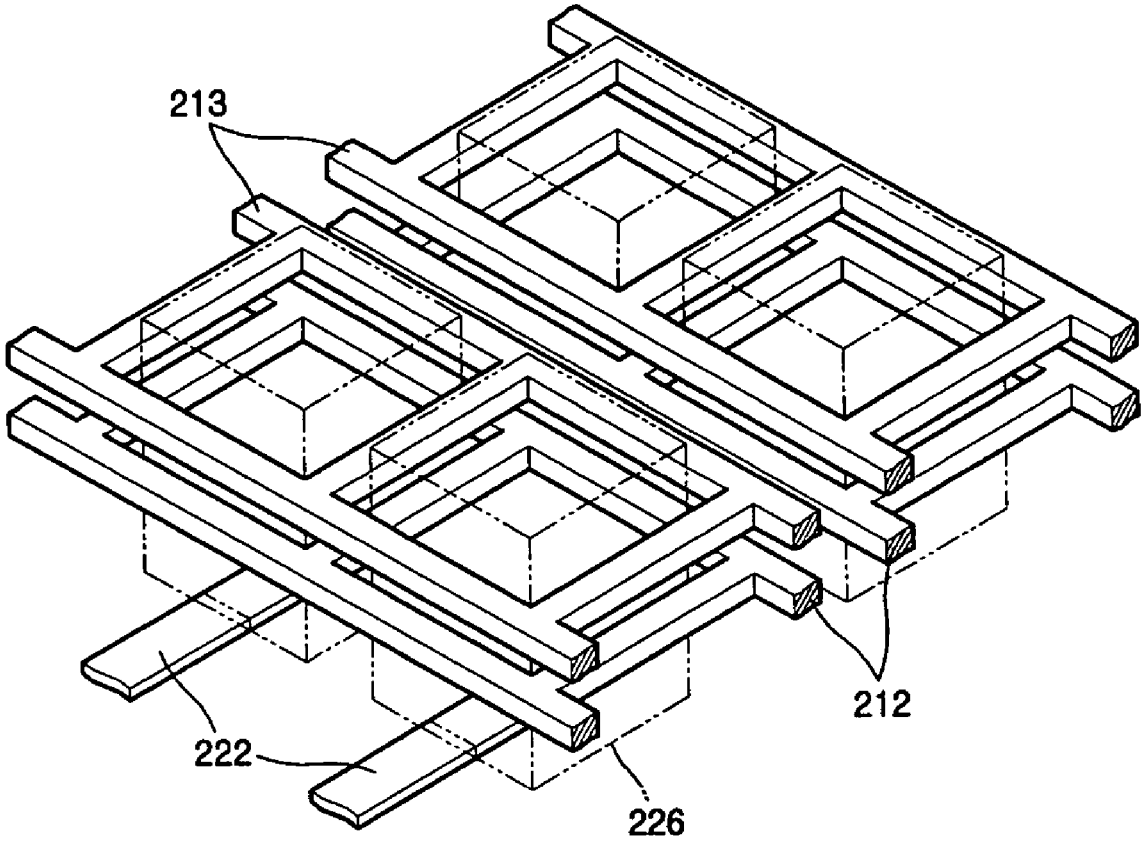
FIG. 3 is a perspective view of a structure of disposing electrodes on the PDP shown in FIG.2.

In the PDP shown in FIG. 2, the upper discharge electrode 213, the lower discharge electrode 212, and the address electrode 222 are disposed as shown in FIG. 3, and the upper and lower discharge electrodes 213 and 212 are formed as ladders. The upper and lower discharge electrodes 213 and 212 form a pair, and extend in a direction to be parallel to each other, and the address electrode 222 extends to cross the upper and lower discharge electrodes 213 and 212. The electrodes are disposed as described above so that the address discharge occurs between one of the lower and upper discharge electrodes 212 and 213 and the address electrode 222 and the sustain discharge occurs between the upper discharge electrode 213 and the lower discharge electrode 212.

Two sustain electrodes that are generally referred to as an X electrode and Y electrode (one sustain electrode pair) and one address electrode 222 are disposed in the discharge cell of the PDP, which is driven by the address discharge and the sustain discharge. The address discharge occurs between the Y electrode and the address electrode 222, and it is desirable that the lower discharge electrode is the Y electrode when the address electrode 222 is disposed under the upper and lower discharge electrodes 213 and 212. When the lower discharge electrode 212 is the Y electrode, the upper discharge electrode 213 becomes the X electrode.

The upper and lower discharge electrodes 213 and 212 of the present embodiment surround the discharge cell 226, unlike the conventional sustain electrodes 112 and 113. Therefore, the sustain discharge occurs along a circumference of the discharge cell 226, and the volume of the space where the sustain discharge occurs is relatively large. Thus, the light emitting efficiency of the PDP according to the present invention is superior than that of the conventional PDP.

Figure 4A:
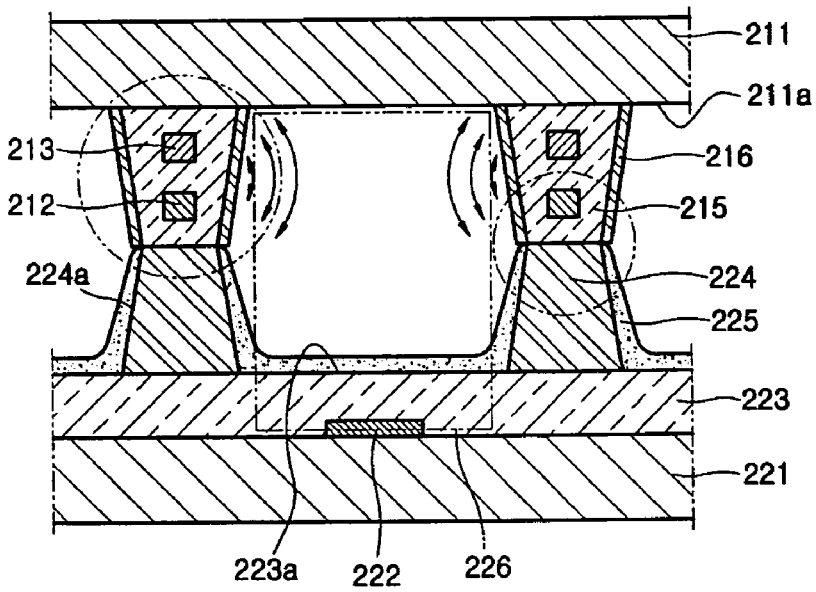
FIG. 4A is a cross-sectional view in line IV—IV direction of FIG. 2.

In addition, in the discharge cell 226 of the PDP according to the present embodiment, the sustain discharge only occurs on an upper portion of the discharge cell 226, that is, near the upper substrate 211 as denoted by the arrow in FIG. 4A. Therefore, ion sputtering of the phosphor caused by the charged particles during the sustain discharge can be reduced, and the generation of a permanent residual image by the degradation of the phosphor layer 225 can be reduced.

In FIGS. 2 through 4C, the address electrodes 222 are disposed between the lower substrate 221 and the phosphor layer 225, and more particularly, on the upper surface 221*a* of the lower substrate 221. However, the positions of the address electrodes 222 are not limited thereto. For example, the address electrodes 222 can be disposed in the upper barrier rib 215 to surround the discharge cell 226. In this case, the address electrode 222 is formed similarly to the upper and lower discharge electrodes 213 and 212 (that is, ladder shaped). However, the address electrodes 222 extend to cross the upper and lower discharge electrodes 213 and 212. In addition, the address electrode 222 can be disposed between the upper discharge electrode 213 and the upper substrate 211, between the upper discharge electrode 213 and the lower discharge electrode 212, or between the lower discharge electrode 212 and the upper barrier rib 215. The address electrode 222 is always separated and insulated from the upper and lower discharge electrodes 213 and 212. The address electrode 222 can be disposed on a portion that defines the discharge cell 226 on the lower surface 211 a of the upper substrate 211. However, in this case, the address electrode 222 must be covered by an additional dielectric layer.

The dielectric layer 223 is disposed between the phosphor layer 225 and the address electrode 222, and the dielectric layer 223 covers the address electrodes 222 to prevent the address electrode 222 from being damaged by the collision of charged particles during the discharge. The dielectric layer 223 is formed of a dielectric that can induce the charged particles, such as PbO, $B2O_3$, and $SiO_2$.

The lower barrier ribs 224 are disposed under the upper barrier ribs 215, and more particularly, between the upper barrier ribs 215 and the dielectric layer 223. The lower barrier ribs 224 define the regions where the phosphor layer including the red color emitting phosphor, the phosphor layer including the green color emitting phosphor, and the phosphor layer including the blue color emitting phosphor are disposed.

The lower barrier rib 224 is preferably formed to be substantially the same shape as the upper barrier rib 215. That is, cross-sections of the spaces respectively defined by the upper barrier rib 215 and the lower barrier rib 224 have the same shapes (quadrangles in FIGS. 4A–4C), and centers of the two cross-sections coincide. In more detail, when the upper barrier rib 215 is formed as a structure that arranges the spaces defined by the upper barrier rib 215 in a matrix form, the lower barrier rib 224 is also formed as a matrix form.

The upper and lower discharge electrodes 213 and 212 are disposed in the upper barrier rib 215 and the upper and lower discharge electrodes 213 and 212 surround the discharge cell 226. Thus, the upper barrier rib 215 defines a space having a closed cross-section. When the lower barrier rib 224 has the same shape as that of the upper barrier rib 215, the lower barrier rib 224 also defines a space having a closed cross-section. In the present invention, the lower barrier rib having the closed cross-section is called as closed type lower barrier rib. When the lower barrier rib 224 has the closed cross-section, an area of the side 224*a* of the lower barrier rib 224 increases, and the area of the phosphor layer 225 also increases. Accordingly, the amount of visible light emitted from one discharge cell is increased, and the light emitting efficiency of the PDP can be improved.

When the lower barrier rib 224 is formed differently from the upper barrier rib 214, for example, if centers of the cross-section of the space defined by the upper barrier rib 215 and the cross-section of the space defined by the lower barrier rib 224 coincide, the cross-section of the space defined by the barrier rib 215 is a circular shape, and the cross-section of the space defined by the lower barrier rib 224 is a quadrangle, some of the ultraviolet (UV) rays emitted by the discharge gas in the space defined by the upper barrier rib 215 can be blocked by the lower barrier rib 224 and cannot reach the phosphor layer 224, or some of the visible (V) light emitted by the phosphor layer 225 cannot proceed toward the upper substrate and can be blocked by the upper barrier rib 215. This problem can be solved by forming the lower barrier rib 224 and the upper barrier rib 215 to have the same shapes as described in the above-noted embodiment of the present invention.

Figure 4B:
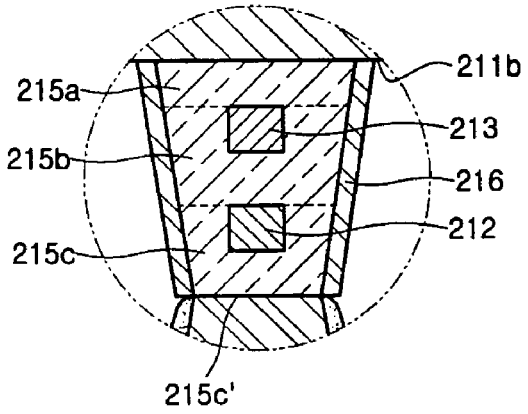
FIGS. 4B and 4C are magnified views of portions of FIG. 4A.
Figure 4C:
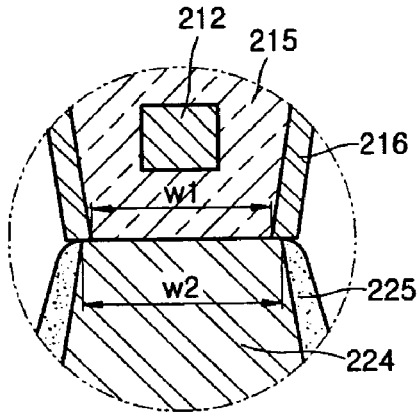

Referring to FIGS. 4A–4C, a relationship between a lower width W1 of the upper barrier rib 215 and an upper width W2 of the lower barrier rib 224 is as follows. Even if the lower barrier rib 224 and the upper barrier rib 215 have the same form, the above described problem can occur when the width W1 of the upper barrier rib 215 and the width W2 of the lower barrier rib 224 are greatly different from each other.

Figure 5:
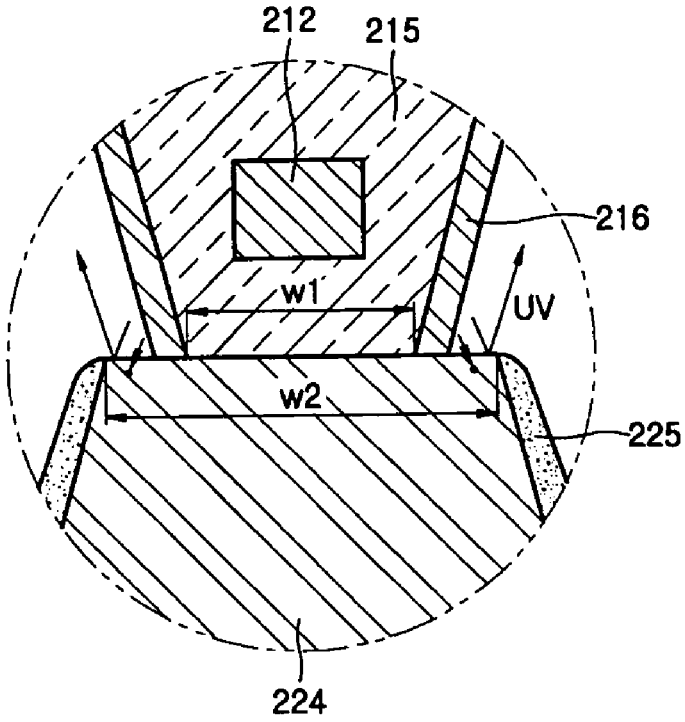
FIG. 5 is a partial cross-sectional view of a first comparative example.
Figure 6:
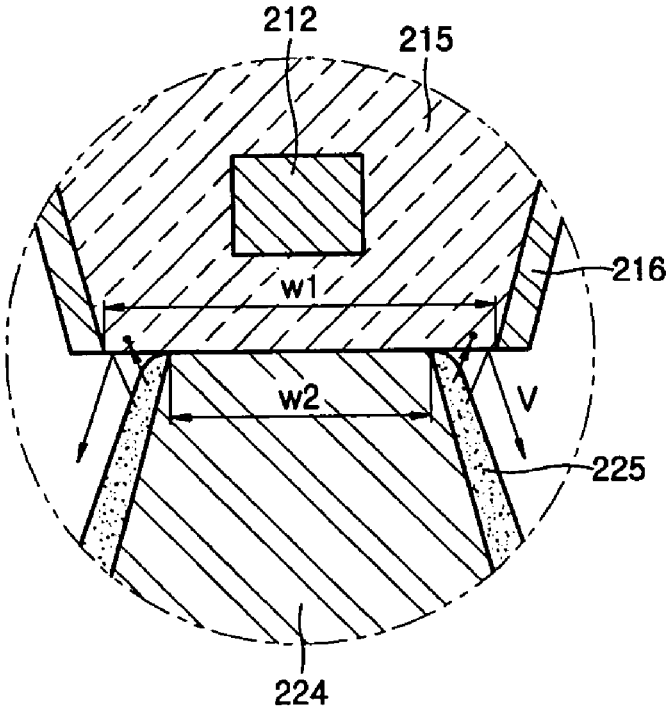
FIG. 6 is a partial cross-sectional view of a second comparative example.

In more detail, as shown in FIG. 5, if the width W1 of the upper barrier rib 215 is significantly smaller than the width W2 of the lower barrier rib 224, some of the ultraviolet rays emitted by the discharge gas in the space defined by the upper barrier rib 215 can be absorbed or reflected by the lower barrier rib 224 and cannot reach the phosphor layer 225. Accordingly, the amount of the visible light emitted from the phosphor layer 225 is reduced. On the contrary, as shown in FIG. 6, when the width W1 of the upper barrier rib 215 is significantly larger than the width W2 of the lower barrier rib 224, some of the visible light emitted by the phosphor layer 225 are absorbed or reflected by the upper barrier 215 and cannot proceed toward the upper substrate 211. Accordingly, the amount of visible light passing through the upper substrate 211 is reduced.

Therefore, the relationship between the lower width W1 of the upper barrier rib 215 and the upper width W2 of the lower barrier rib 224 can preferably be represented as $(|W1-W2|)/W1<0.1$ and $(|W1-W2|)/W2<0.1$. It is more preferable for the width W1 of the upper barrier rib 215 to be the same as the width W2 of the lower barrier rib. However, when the width W1 and the width W2 are set, other characteristics (besides the light emitting efficiency) of the PDP and conditions of fabricating processes (for example, processing errors) must be considered, and accordingly, the width W1 and the width W2 can be slightly different from each other.

On the other hand, the protective layer 215 formed on the side surface of the upper barrier rib 215 is very thin, that is, about 0.7 μm, and the phosphor layer formed on the uppermost part of the side surface of the lower barrier rib 224 is thin, that is, about 0~3 μm. Therefore, these do not significantly affect the passage of the UV rays and visible light. The width W1 of the upper barrier rib 215 and the width W2 of the lower barrier rib 224 are respectively about 30~100 μm.

The upper barrier rib 215 and the lower barrier rib 224 can be formed integrally with each other. In this case, it can be difficult to discriminate a boundary between the upper barrier rib 215 and the lower barrier rib 224. It should be understood that the width W1 of the upper barrier rib 215 and the width W2 of the lower barrier rib 224 are the same. The integral forming of the upper barrier rib 215 and the lower barrier rib 224 does not mean that the upper barrier rib 215 and the lower barrier rib 224 are formed at one time with a single process, but rather means that the upper barrier rib 215 and the lower barrier rib 224 are not separated from each other without being damaged.

The phosphor layer 225 disposed in the discharge cell 226, and more particularly, on the upper surface 223*a* of the dielectric layer 223 and the side surface 224*a* of the lower barrier rib 224 is formed by applying a phosphor paste, including a red, green, or blue color emitting phosphor, a solvent, and a binder, onto the upper surface 223*a* and the side surface 224*a*, and drying and baking the paste. The red color emitting phosphor can be $Y(V,P)O_4$:Eu, the green color emitting phosphor can be $Zn_2SiO_4$:Mn, and $YBO_3$:Tb, and the blue color emitting phosphor can be BAM:Eu.

In FIGS. 2 and 4C, the phosphor layer 225 is disposed on the upper surface 223*a* of the dielectric layer 223 and the side surface 224*a* of the lower barrier rib 224. However, since the phosphor layer 225 receives the UV rays emitted from the discharge gas and emits visible light, the location of the phosphor layer 225 is not limited to the upper surface 223*a* of the dielectric layer 223 and the side surface 224*a* of the lower barrier rib 224, but can be anywhere in the discharge cell 226.

The discharge gas is contained within the discharge cell 226. The discharge gas is an Ne—Xe mixed gas including 5%~15% of Xe, for example. Ne can be substituted for He if necessary.

The PDP having the above-noted structure operates as follows. When an address voltage Va is applied between the address electrode 222 and the lower discharge electrode 212 to cause the address discharge, the discharge cell 226, within which the sustain discharge will occur, is selected by the result of the address discharge. The selection of discharge cell 226, in which the sustain discharge will occur, means that wall charges are accumulated so that the sustain discharge can occur in an area of the upper barrier rib 215 (of the protective layer 216 if the upper barrier rib 215 is covered by the protective layer 216) adjacent to the upper and lower discharge electrodes 213 and 212. When the address discharge is completed, positive ions are accumulated in a region adjacent to the lower discharge electrode 212 and electrons are accumulated in a region adjacent to the upper discharge electrode 213.

After performing the address discharge, when a sustain voltage Vs is applied between the lower discharge electrode 212 and the upper discharge electrode 213 of the selected discharge cell 226, the positive ions adjacent to the lower discharge electrode 212 and the electrons adjacent to the upper discharge electrode 213 collide with each other to cause the sustain discharge. While the sustain discharge progresses, the sustain voltage is reversely and alternately applied between the lower discharge electrode 212 and the upper discharge electrode 213.

The energy level of the discharge gas is increased by the sustain discharge, and when the increased energy level of the discharge gas begins to decrease, ultraviolet rays are emitted from the discharge gas. The ultraviolet rays cause the energy level of the phosphor included in the phosphor layer 225 disposed in the discharge cell 226 increase, and when the increased energy level begins to decrease, visible light is emitted from the phosphor layer 225. The image is displayed on the PDP by the visible light emitted by the discharge cells 226.

The first embodiment of the present invention can be modified as follows. When the PDP is driven by two electrodes, that is, the upper discharge electrode 213 and the lower discharge electrode 212, and there is no address electrode 222, the upper discharge electrode 213 extends in one direction and the lower discharge electrode 212 extends to cross the upper discharge electrode 213. Since there is no address electrode 222, the dielectric layer 223 is not required. Thus, when there is no dielectric layer 223, the lower barrier rib 224 is formed on the upper surface 221*a* of the lower substrate 221, and the phosphor layer 225 is formed on the upper surface 221 a of the lower substrate 221 and the side surface 224*a* of the lower barrier rib 224.

Figure 7:
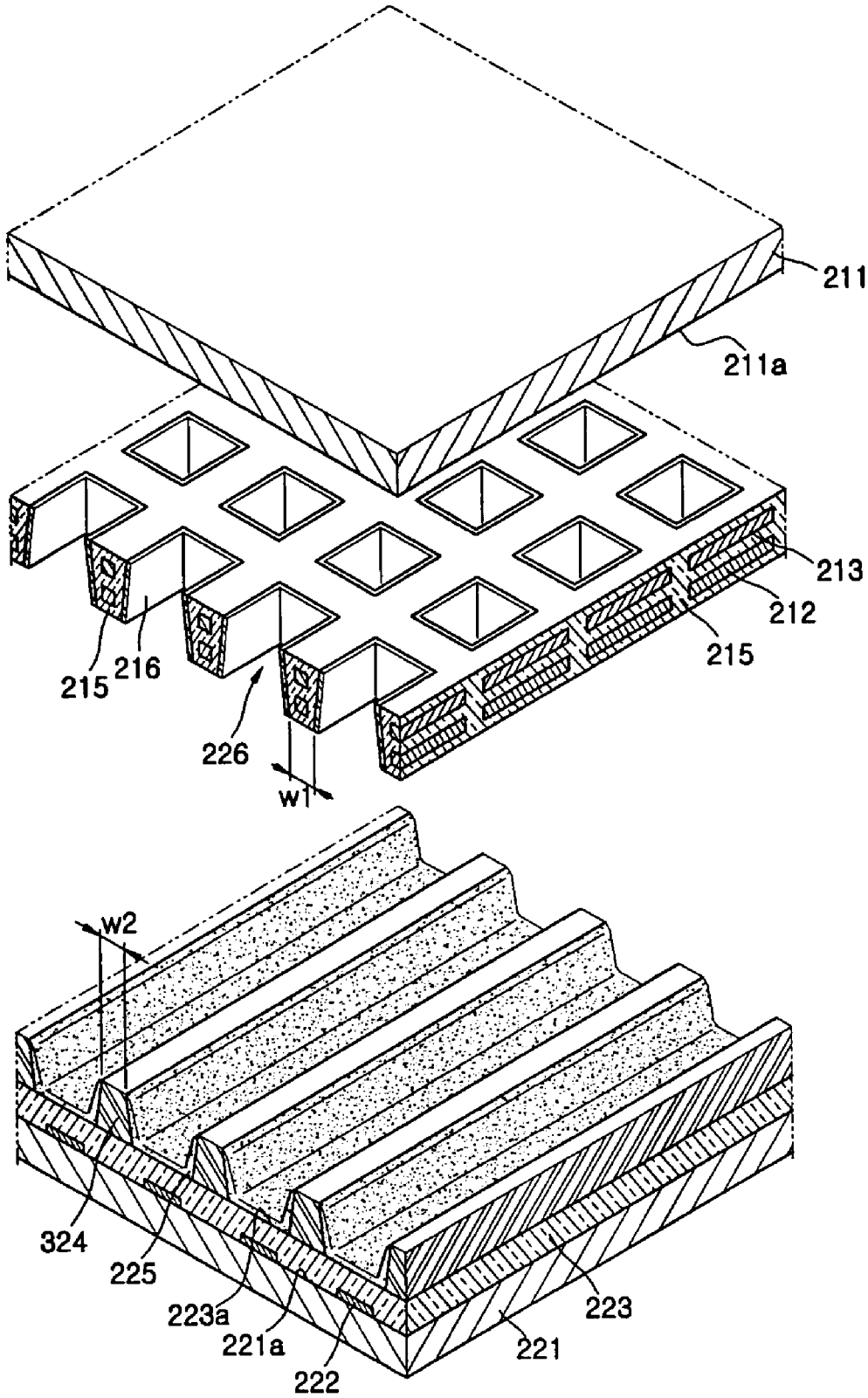
FIG. 7 is a partially exploded perspective view of a PDP according to a second embodiment of the present invention.

Hereinafter, the PDP according to a second embodiment of the present invention will be described with reference to FIG. 7 based on the differences from the first embodiment. The difference of the second embodiment from the first embodiment is that a lower barrier rib 324 is an open type. That is, the adjacent discharge cells 226 defined by the upper barrier rib 215 are not closed by the lower barrier rib 324. In FIG. 7, the lower barrier rib 324 is formed as a stripe. However, the shape of lower barrier rib 324 is not limited thereto. When the lower barrier rib 324 is an open type, impure gas can be discharged easily and the discharge gas can be charged easily in the processes of fabricating the PDP.

When the lower barrier rib 324 is an open type in the second embodiment of the present invention, it is preferable for some of the ultraviolet rays emitted by the discharge gas to not be blocked by the lower barrier rib 324 and it is preferable for some of the visible light emitted by the phosphor layer 225 to not be blocked by the upper barrier rib 215. Therefore, it is preferable for the relationship between the lower width W1 of the upper barrier rib 215 and the upper width W2 of the lower barrier rib 324 to be: $(|W1-W2|)/W1<0.1$ and $(|W1-W2|)/W2<0.1$. In addition, it is more preferable that the width W1 of the upper barrier rib 215 and the width W2 of the lower barrier rib 324 are the same to improve the light emitting efficiency.

The other features of the second embodiment that are not described above are same as those of the first embodiment.

According to the present invention, a PDP is provided having improved light emitting efficiency.

In addition, the discharge of impure gas can be performed easily, and the discharge gas can be charged easily.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP) comprising:

a upper substrate;

a lower substrate arranged in parallel with the upper substrate;

upper barrier ribs arranged between the upper substrate and the lower substrate, the upper barrier ribs including a dielectric and defining discharge cells with the upper and lower substrates;

a plurality of upper discharge electrodes arranged within the upper barrier ribs to surround the discharge cells;

a plurality of lower discharge electrodes arranged within the upper barrier ribs to surround the discharge cells, the lower discharge electrodes being separated from the upper discharge electrodes, at least one of the plurality of upper discharge electrodes and the plurality of lower discharge electrodes includes a plurality of separate electrodes;

lower barrier ribs of closed type arranged under the upper barrier ribs, the lower barrier ribs having the same shape as the upper barrier ribs;

a phosphor layer arranged in each of the discharge cells; and a discharge gas contained within each discharge cell.

2. The PDP of claim 1, wherein $(|W1-W2|)/W1$ and $(|W1-W2|)/W2$ are each less than 0.1, with W1 being a lower width of the upper barrier ribs and W2 being an upper width of the lower barrier ribs.

3. The PDP of claim 2, wherein W1 and W2 are equal.

4. The PDP of claim 3, wherein the upper barrier ribs and the lower barrier ribs are respectively formed integrally with each other.

5. The PDP of claim 1, wherein the upper discharge electrodes extend in one direction and the lower discharge electrodes extend in a direction crossing the upper discharge electrodes.

6. The PDP of claim 5, wherein the phosphor layer is arranged on an upper surface of the lower substrate and side surfaces of the lower barrier ribs.

7. The PDP of claim 1, wherein the upper discharge electrodes and the lower discharge electrodes extend in parallel to each other, and wherein address electrodes extend in a direction crossing the upper and lower discharge electrodes.

8. The PDP of claim 7, wherein the address electrodes are arranged between the lower substrate and the phosphor layer, and a dielectric layer is arranged between the phosphor layer and the address electrodes.

9. The PDP of claim 8, wherein the phosphor layer is arranged on an upper surface of the dielectric layer and the side surfaces of the lower barrier ribs.

10. The PDP of claim 1, wherein the upper discharge electrodes and the lower discharge electrodes have ladder shapes, and at least a side surface of the upper barrier ribs is covered by a protective layer.

11. A Plasma Display Panel (PDP) comprising:

a upper substrate;

a lower substrate arranged in parallel to the upper substrate;

upper barrier ribs arranged between the upper substrate and the lower substrate, the upper barrier ribs including a dielectric and defining discharge cells with the upper and lower substrates, each of the upper barrier ribs having a lower width W1;

upper discharge electrodes arranged within the upper barrier ribs to surround the discharge cells;

lower discharge electrodes arranged within the upper barrier ribs to surround the discharge cells, the lower discharge electrodes being separated from the upper discharge electrodes;

lower barrier ribs of an open type arranged under the upper barrier ribs, the lower barrier ribs each having an upper width W2;

a phosphor layer arranged within each of the discharge cells; and a discharge gas contained within the each discharge cell;

wherein $(|W1-W2|)/W1$ and $(|W1-W2|)/W2$ are each less than 0.1.

12. The PDP of claim 11, wherein W1 and W2 are equal.

13. The PDP of claim 12, wherein the upper barrier ribs and the lower barrier ribs are respectively formed integrally with each other.

14. The PDP of claim 11, wherein the upper discharge electrodes extend in one direction, and the lower discharge electrodes extend in a direction crossing the upper discharge electrodes.

15. The PDP of claim 14, wherein the phosphor layer is arranged on an upper surface of the lower substrate and side surfaces of the lower barrier ribs.

16. The PDP of claim 11, wherein the upper discharge electrodes and the lower discharge electrodes extend in parallel to each other, and wherein address electrodes extend in a direction crossing the upper and lower discharge electrodes.

17. The PDP of claim 16, wherein the address electrodes are arranged between the lower substrate and the phosphor layer, and a dielectric layer is arranged between the phosphor layer and the address electrodes.

18. The PDP of claim 17, wherein the phosphor layer is arranged on an upper surface of the dielectric layer and the side surfaces of the lower barrier ribs.

19. The PDP of claim 11, wherein the upper discharge electrode and the lower discharge electrode have ladder shapes, and wherein at least a side surface of the upper barrier ribs is covered by a protective layer.

* * * * *